US005797143A

United States Patent [19]

Buxton

[11] Patent Number: 5,797,143

[45] Date of Patent: Aug. 25, 1998

[54] VEST PACK WITH BACK AND NECK SUPPORTS

[76] Inventor: Bradly J. Buxton, 2912 N. Battleground Ave., Greensboro, N.C. 27408

[21] Appl. No.: 593,448

[22] Filed: Jan. 29, 1996

[51] Int. Cl.[6] ..... A41D 1/04

[52] U.S. Cl. ..... 2/102; 2/44; 2/94

[58] Field of Search ..... 2/102, 94, 108, 2/85, 44, 45, 267, 92, 455, 456, 69, 69.5; 602/19, 61; 383/4

[56] References Cited

U.S. PATENT DOCUMENTS

| | | | |
|---|---|---|---|
| 1,486,676 | 3/1924 | Niussen . | |
| 1,879,341 | 9/1932 | Lapham . | |
| 2,418,009 | 3/1947 | Berman . | |
| 3,261,042 | 7/1966 | Baker . | |
| 3,266,070 | 8/1966 | O'link | 2/102 |
| 3,554,190 | 1/1971 | Kaplan . | |
| 4,302,847 | 12/1981 | Miles | 2/102 |
| 4,555,234 | 11/1985 | Kent . | |
| 4,572,167 | 2/1986 | Brunswick . | |
| 4,658,442 | 4/1987 | Tomlinson et al. . | |
| 4,800,593 | 1/1989 | Ruffner | 2/102 |
| 4,820,221 | 4/1989 | Aubrey . | |
| 4,821,339 | 4/1989 | Fair | 2/102 |
| 4,837,859 | 6/1989 | Hamberg . | |
| 4,884,295 | 12/1989 | Cox | 2/44 |
| 5,002,270 | 3/1991 | Shine | 2/102 |
| 5,007,412 | 4/1991 | DeWau . | |
| 5,075,900 | 12/1991 | Chittenden . | |
| 5,195,187 | 3/1993 | Yang . | |
| 5,278,998 | 1/1994 | Book . | |

*Primary Examiner*—Gloria M. Hale
*Attorney, Agent, or Firm*—Rhodes, Coats & Bennett, L.L.P.

[57] ABSTRACT

A garment for supporting the lower back of a wearer. The garment includes a back panel including a cushion member. A pair of side panels are each attached to a respective side edge of the back panel. Support means are attached to each of the side panels to suspend the garment from the wearer's shoulders. The cushion member is positionable with respect to the wearer such that at least a portion of the cushion member supports the lower back of the wearer when the garment is being worn. Preferably, the cushion member includes a lower portion and an upper portion, the lower portion adapted to support the lower back of the wearer when the garment is being worn and the upper portion adapted to support the wearer's neck when the garment is not being worn. Further, the lower portion is preferably thicker than the upper portion. One or more of the side panels may include a pair of subpanels. The subpanels are coupled to one another so as to define a pocket and an opening therebetween, the opening being in communication with the pocket. Preferably, at least one of the subpanels includes a cushion panel.

26 Claims, 3 Drawing Sheets

VEST PACK WITH BACK AND NECK SUPPORTS

FIELD OF THE INVENTION

The present invention is directed to garments, and more particularly, to a garment providing carrying means and neck and back supports.

BACKGROUND OF THE INVENTION

Certain activities such as sitting in stadium seats for long periods while attending sporting events, theater, or the like place inordinate strain on one's back causing some to avoid such activity altogether. Alternatively, one may use a back support of some type to ease the strain placed on the lower back. Unfortunately, such back supports are rather cumbersome and are inconvenient to transport to and from one's seat. Thus, there exists a need for a convenient and effective means for supporting one's lower back when in a seated position.

A further problem encountered when attending events staged in public arenas as well as when going to the beach, pool, or the like is the need for carrying means. Frequently, one will carry a bag or a backpack in order to transport multiple items. If a bag is used, at least one hand is occupied by the bag. If a backpack is used, it must be removed before sitting in a seat. In either case, if only limited space is provided between rows, it is often necessary that the user hold the backpack or bag in his or her lap. While it is known to provide jackets or vests with pockets, such jackets or vests typically have very limited carrying capacity. Further, there is generally nothing to keep the objects held in the pockets cushioned from impact with the wearer except layers of cloth. Moreover, such garments do not generally include any means for keeping objects, for example drinks, temperature insulated. Thus, there exists a need for a convenient, hands-free means for carrying objects. Further, there exists a need for such a carrying means which provides cushioning between the wearer and the carried objects. There exists a need for such a carrying means which provides for insulation of the objects such as drinks, food and the like.

A somewhat related problem occurs when relaxing at the pool, beach, or the like. Laying prone on the ground or a lounge chair is often uncomfortable for one's neck. Ideally, a pillow or other means are provided for supporting the neck. Again, however, a pillow or the like is usually too cumbersome to be carried to the beach or pool. Thus, there exists a need for a convenient and effective means for supporting one's neck when in the prone or side posture positions.

A further problem encountered at the beach, in particular, is lack of security for personal items. If valuables are left in a beach bag or the like beside the owner, there is a danger that a thief may simply grab the bag and run. Thus, there exists a need for means for insuring that the valuables of a prone or seated person cannot be easily acquired and carried away.

SUMMARY OF THE INVENTION

The present invention is directed to a garment for supporting the lower back of a wearer when the same is being worn and the user is seated with his or her back against a seat back. The garment includes a back panel including a cushion member and having a pair of side edges. A pair of side panels are attached by edges thereof to a respective one of the back panel side edges. Support means, preferably straps having adjustment means, are attached to each of the side panels and serve to suspend the garment from the wearer's shoulders. In use, the cushion member is positionable with respect to the wearer such that at least a portion of the cushion member supports the lower back of the wearer when the garment is being worn. Coupling means may be provided for selectively connecting the pair of side panels.

More particularly, the cushion member may include a lower portion and an upper portion. The lower portion is arranged and configured to support the lower back of the wearer when the garment is being worn. The upper portion is arranged and configured to support the wearer's neck when the garment is not being worn. Preferably, the lower portion is thicker than the upper portion. Moreover, the diameter of the lower portion is preferably greater than the diameter of the upper portion.

The cushion member as described above may further include one or more intermediate portions connecting the lower portion and the upper portion and also preferably arranged and configured to support the neck of the wearer when the garment is removed. In a preferred embodiment, the cushion member includes a pair of the intermediate portions, each of the pair of intermediate portions extending along a respective one of the side edges of the back panel. The upper, lower, and intermediate portions thereby define a hole within the cushion member. The lower portion is preferably thicker than the intermediate portion or portions. Further, the diameter of the lower portion is preferably greater than the diameter of the intermediate portion or portions.

One or both of the side panels may be provided with a pair of subpanels. The subpanels are coupled to one another so as to define a pocket and an opening therebetween, the opening being in communication with the pocket. The opening is preferably provided with selectively openable closure means such as a zipper or the like. One or more of the subpanels may include a cushion panel. An auxiliary pocket may be provided on one of the side panels.

An object of the present invention is to provide a convenient and effective means for supporting one's lower back when in a seated position.

A further object of the present invention is to provide such a support means which is also a convenient, hands-free means for carrying objects.

Moreover, an object of the present invention is to provide such a carrying means which provides cushioning between the wearer and the carried objects as well as exterior surfaces and impacts.

It is also an object of the present invention to provide such a carrying means which provides for water resistance and insulation of the objects such as drinks, food and the like.

An object of the present invention is to provide a support means as described above which further serves as a convenient and effective means for supporting one's neck when in the prone and side posture positions.

Yet another object of the present invention is to provide means for insuring that the valuables of a prone or seated person cannot be easily acquired and carried away.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 1:
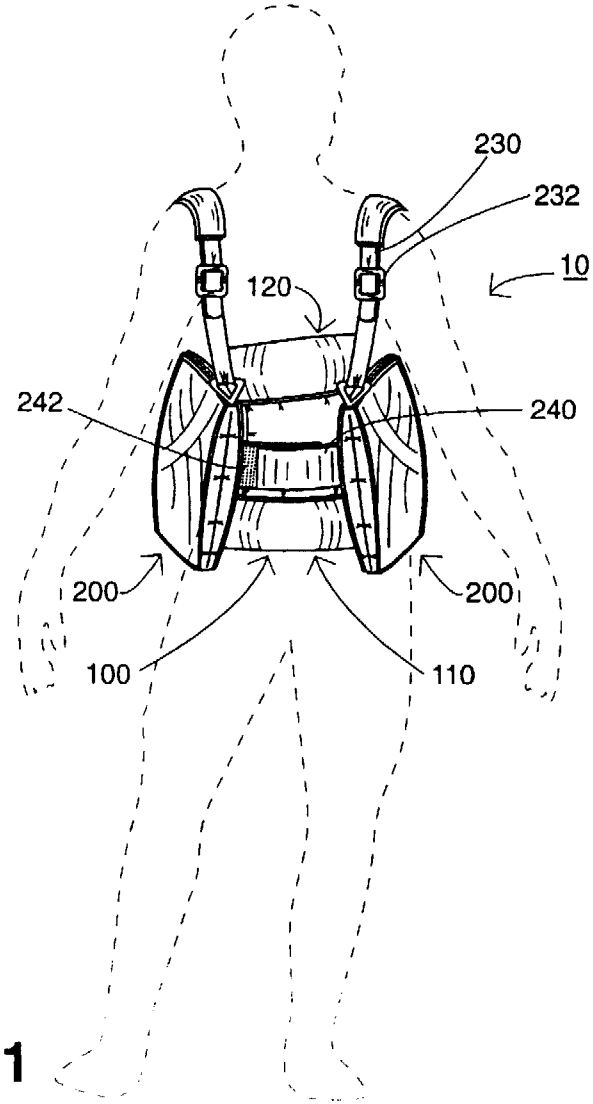
FIG. 1 is a front perspective view of a vest according to the present invention as worn.

As best seen in FIG. 1, a vest according to the present invention and generally denoted by the numeral 10 includes back panel 100 and a pair of side panels 200 extending therefrom. Panels 100, 200 are adapted to surround the torso of the wearer and to be supported by straps 230 extending over the wearer's shoulders. Straps 230 may be replaced with integral arm holes or the like. Further, vest 10 may be formed with sleeves or the like to form a shirt or jacket.

Figure 3:
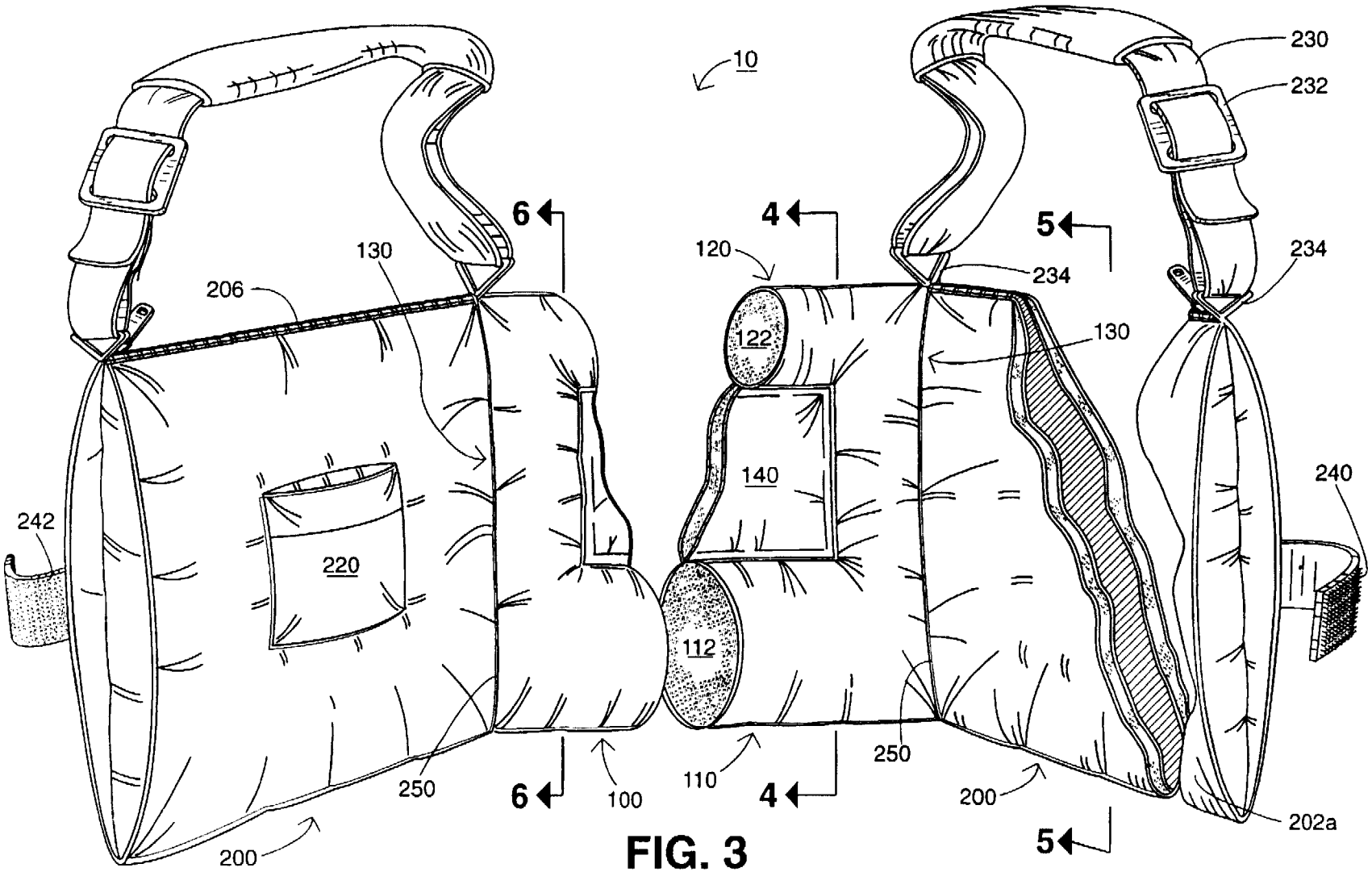
FIG. 3 is a front, open, perspective view of the vest.
Figure 6:
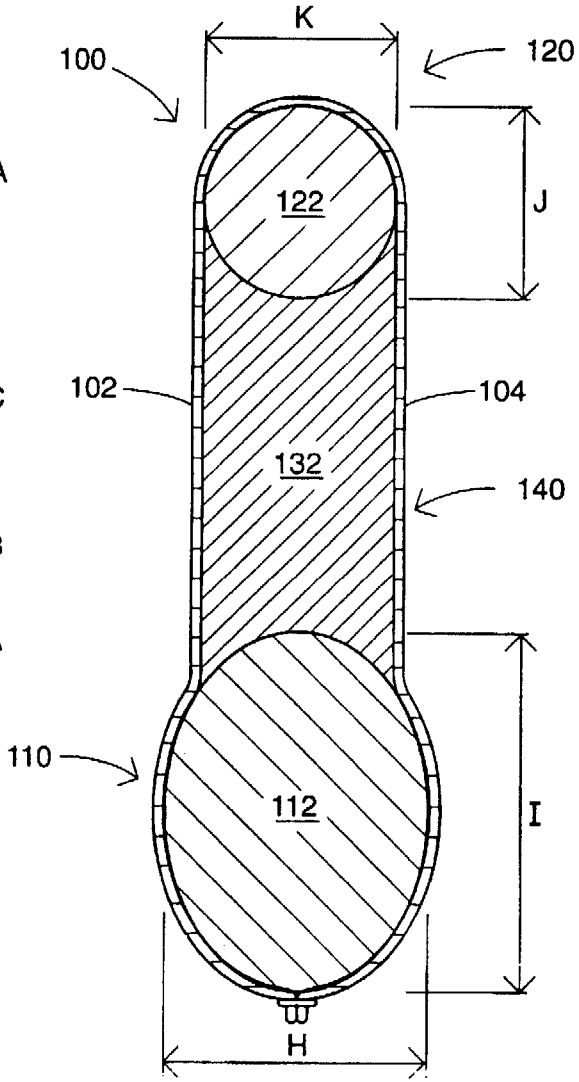
FIG. 6 is a cross sectional view of the back panel of the vest as viewed along the line 6—6.
Figure 4:
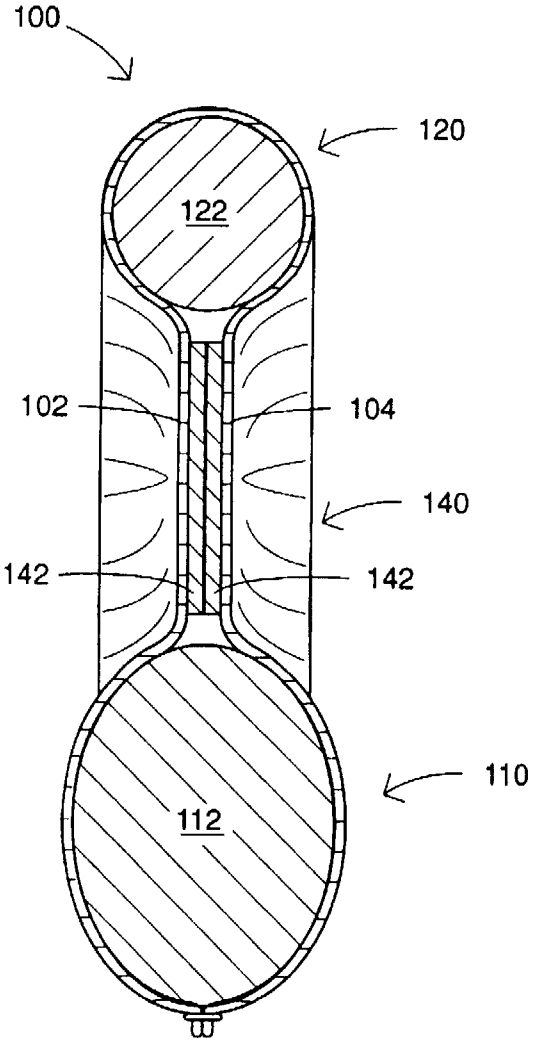
FIG. 4 is a cross sectional view of the back panel of the vest as viewed along the line 4—4.

As best seen in FIGS. 3 and 4, back panel 100 includes back support section 110, upper neck support section 120, and a pair of side or intermediate neck support sections 130. Back panel 100 incorporates a preferably rectangular shaped cushion formed from cushions 112, 122, and 132. Cushions 112, 122, and 132 are preferably formed as or bonded to form a single cushion defining a hole or cutout portion 140. The cushions are enveloped by cover panels 102, 104 formed from a durable water proof or water resistant material such as cordura, leather, plastic, or any other suitable fabric. Cushion panels 142 are preferably fused, bonded, sewn or otherwise secured to the interior surface of cover panels 102, 104 in the area defined by cutout 140. Preferably, cushion panels 142 cover substantially the entire area of cutout 140. Cushion panels 142 are preferably about one quarter inch thick and are formed from foam rubber or other suitable material.

Figure 2:
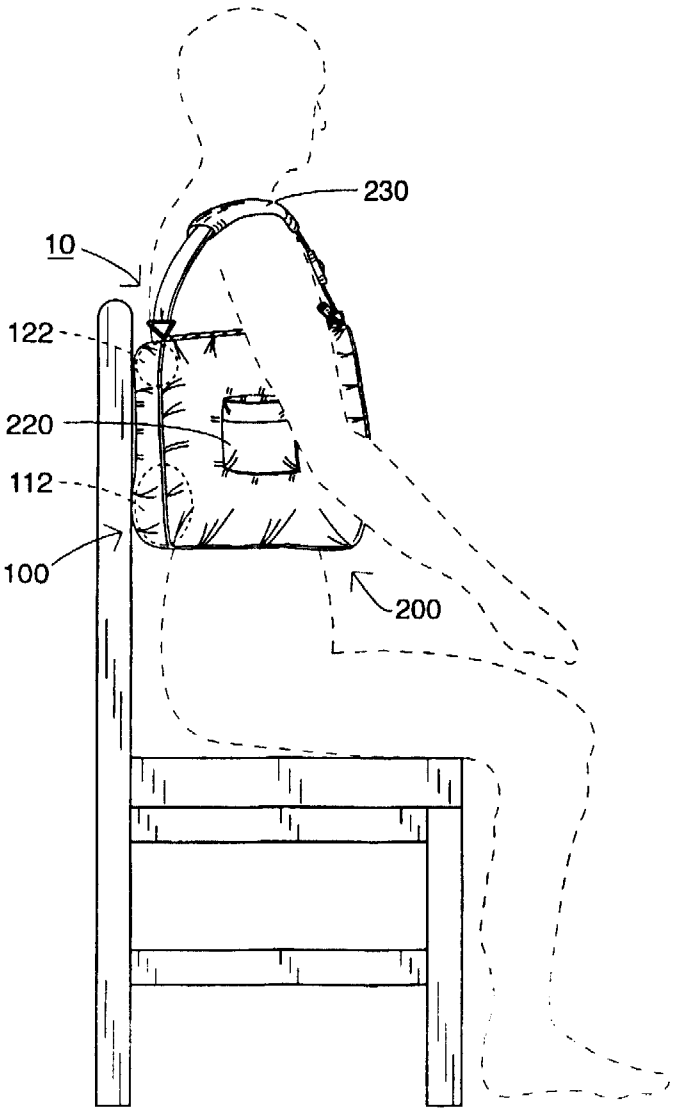
FIG. 2 is a side elevational view of the vest as worn by a user seated in a chair.

Turning now to FIG. 2, back panel 100 is adapted to support the wearer's lower back when the wearer is seated with his or her lower back against a seat back 5. To this end, back support section 110 is provided proximate the lower back when the vest is worn by the wearer and suitably adjusted. Back support section 110 braces the lower back against the seat back 5 to insure a comfortable position wherein the user's lower back may be relatively relaxed. With reference to FIGS. 3, 4, 5 and 6, back support section 110 includes cushion 112. Cushion 112 is preferably from about 14 to about 16 inches long (i.e., extending from one side of the wearer to the other), from about 4 to about 6.5 inches deep or thick (i.e., extending away from the wearer; dimension H), and from about 4 to about 6.5 inches wide or high (i.e., extending up the wearer's back; dimension I). Cushion 112 preferably provides medium to firm support. Suitable cushioning materials include medium to firm foam rubber or like materials for preferred support and comfort. Preferably, about 1532 foam (i.e., 1.5 lbs. density, 32 lbs. compression with range of 28–36 lbs. compression) is used. Suitable cushions are available from Southeastern Foam Rubber Company of High Point, N.C.

Neck support sections 120 and 130 including cushions 122 and 132, respectively, are provided to support the user's neck. When it is desired to exercise this function of vest 10, the user simply removes vest 10, lays the vest on the intended surface, and lays his or her neck over one of neck support sections 120, 130 as desired such that his or her head rests on cushion panels 142 in cutout section 140. Any one of neck support sections 120, 130 may serve as the neck support depending on the environment of the user and whether or not the user wants to lay on top of a side panel 200. Notably, when the user's head is resting on the cushion, the vest containing valuables cannot be taken without displacing and alerting the user, if at all. Cushions 122 and 132 are preferably from about 14 to about 16 inches long (i.e., extending across and up the wearer's back, respectively), from about 3 to about 4.5 inches deep or thick (i.e., dimension K), and from about 3 to about 4.5 inches wide (i.e., dimension J). Preferably cushions 122 and 132 are circular in cross section, as shown, with a diameter of from about 3 inches to about 4.5 inches. Cushions 122 and 132 preferably provide medium to firm support. Suitable cushioning materials include foam rubber or like materials. Preferably, about 1845 foam (i.e., 1.8 lbs. density, 45 lbs. compression with range of 35–55 lbs. compression) is used. Suitable cushions are available from Southeastern Foam Rubber Company.

Figure 5:
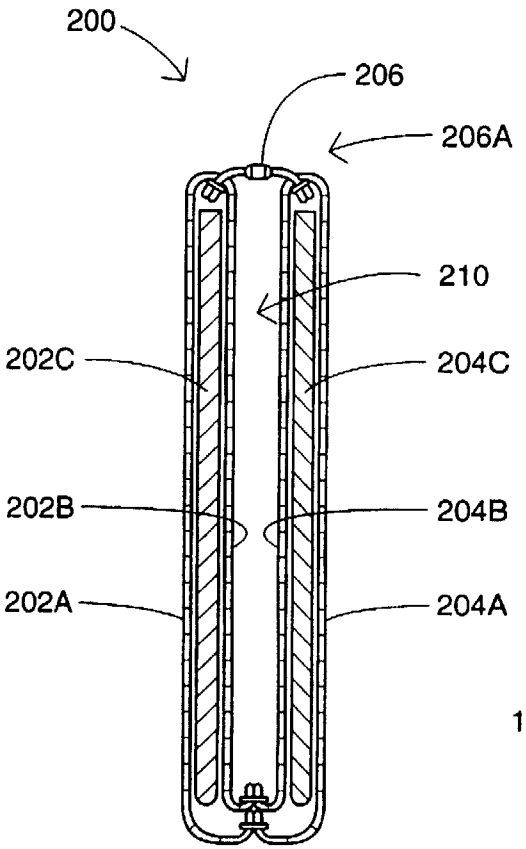
FIG. 5 is a side cross sectional view of a side panel of the vest as viewed along the line 5—5.

As best seen in FIGS. 3 and 5, side panels 200 are attached to respective side edges of back panel 100 along folds 250. Panels 200 may be joined to back panel 100 by any suitable means, for example, by sewing, fusing, bonding, or using a common piece of material. Each panel 200 includes inner panels 202B, 204B of suitable material, such as cordura, leather, plastic, or other suitable fabric. Inner panels 202B, 204B are preferably water proof or water resistant. Panels 202B, 204B define pocket 210. Panels 202B, 204B are preferably joined about their peripheries so that substantially all of the side panel forms the pocket, thereby maximizing the size and carrying capacity of the pocket. Preferably, the pockets are about 15 inches square.

Side panels 200 are also provided with outer panels 202A, 204A which, together with interior panels 202B, 204B form cavities or compartments for cushion panels 202C and 204C, respectively. Each side panel 200 is preferably provided with a zipper 206 or other fastening means for selectively closing opening 206A of pocket 210. Cushion panels 202C, 204C are preferably about one quarter to one eighth inch thick and may be formed from medium to firm foam rubber or other suitable material. Preferably, cushion panels 202C, 204C are formed from about 1545 foam (i.e., 1.5 lbs. density, 45 lbs. compression with range of 40–50 lbs. compression). Suitable foam materials are available from Southeastern Foam Rubber Company. If the user chooses to lay his or her neck across one of side neck support sections 130, then cushion panels 202C of the adjacent side panel 200 will serve as a back cushion.

Pockets 210 are particularly advantageous when used for the purposes discussed in the Background of the Invention. Pockets 210 provide significant carrying capacity without the awkwardness of backpacks or bags. Further, the provision of cushion panels 202C, 204C serves to protect the wearer from impact with the objects carried in pockets 210. Moreover, hot or cold drinks or the like carried in pockets 210 are temperature insulated by cushion panels 202C, 204C.

If desired, an approximately 6 inch by 5 inch auxiliary pocket 220 may be provided on one or more of the outer cover panels. Preferably, vest 10 is constructed so as to be reversible, in which case, auxiliary pocket 220 may be worn outwardly for convenient access or against the body of the wearer for security. Auxiliary pocket 220 is particularly useful for carrying keys, identification cards, jewelry, and other small valuables. The pocket 220 preferably has a VELCRO™ closure (not shown).

Straps 230 are preferably padded and include slide adjuster 232 or other suitable adjusting means so that the height of vest 10, and more particularly back support section 110, with respect to the lower back of the wearer may be selectively chosen. Strap 230 is secured to the corners of side panels 200 by rings 234, though any suitable means may be used.

Belt-type VELCRO™ closures 240, 242 or the like are preferably provided for securing and stabilizing vest 10 about the torso of the wearer. Other coupling means such as buttons, snaps, and the like may be used as well.

Preferably, the cushions and other materials of vest 10 are chosen such that vest 10 is buoyant in water. Panels 102, 104, 202A, 202B, 204A, and/or 204B may be formed of or coated with a water-proof or water-resistant material.

Methods and materials of manufacture will be readily apparent to those of ordinary skill in the art upon a reading of the foregoing description.

While a preferred embodiment of the present invention has been described, it will be appreciated by those of skill in the art that certain modifications may be made without departing from the scope of the present invention. For example, the vest may be formed without cushions 142, without cushion 112, without cushion 122, without one or both of cushions 132, or without each of cushions 122, 132. All such modifications are intended to come within the scope of the claims which follow.

What is claimed is:

1. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders;

d) wherein said cushion member is positionable with respect to the wearer such that at least a portion of said cushion member supports the lower back of the wearer when the garment is being worn; and e) wherein said cushion member includes a lower portion and an upper portion, said lower portion being thicker than said upper portion said lower portion arranged and configured to support the lower back of the wearer when the garment is being worn and said upper portion arranged and configured to support the wearer's neck when said garment is not being worn.

2. The garment of claim 1 wherein said support means includes a pair of straps and adjustment means for adjusting the lengths of said straps.

3. The garment of claim 1 further including coupling means for selectively connecting said pair of side panels.

4. The garment of claim 1 further including an auxiliary pocket mounted on one of said side panels.

5. A garment for supporting the lower back of a wearer comprising:

a) a back panel including a cushion member and having a pair of side edges;

b) a pair of side panels each attached by an edge thereof to a respective one of said side edges, c) support means attached to each of said side panels arranged and configured to suspend said garment from the wearer's shoulders;

d) wherein said cushion member is positionable with respect to the wearer such that at least a portion of said cushion member supports the lower back of the wearer when the garment is being worn; and e) wherein said cushion member includes a lower portion and an upper portion, a diameter of said lower portion being greater than a diameter of said upper portion, said lower portion arranged and configured to support the lower back of the wearer when the garment is being worn and said upper portion arranged and configured to support the wearer's neck when said garment is not being worn.

6. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders;

d) wherein said cushion member is positionable with respect to the wearer such that at least a portion of said cushion member supports the lower back of the wearer when the garment is being worn;

e) wherein said cushion member includes a lower portion, an upper portion, and at least one intermediate portion connecting said lower portion and said upper portion, said lower portion arranged and configured to support the lower back of the wearer when the garment is being worn and said upper portion arranged and configured to support the wearer's neck when said garment is not being worn; and f) wherein said intermediate portion is arranged and configured to support the neck of the wearer when the garment is not being worn and said lower portion is thicker than said intermediate portion.

7. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders;

d) wherein said cushion member is positionable with respect to the wearer such that at least a portion of said cushion member supports the lower back of the wearer when the garment is being worn;

e) wherein said cushion member includes a lower portion an upper portion, and at least one intermediate portion connecting said lower portion and said upper portion, said lower portion arranged and configured to support the lower back of the wearer when the garment is being worn and said upper portion arranged and configured to support the wearer's neck when said garment is not being worn; and f) wherein said intermediate portion is arranged and configured to support the neck of the wearer when the garment is not being worn and a diameter of said lower portion is greater than a diameter of said intermediate portion.

8. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders;

d) wherein said cushion member is positionable with respect to the wearer such that at least a portion of said cushion member supports the lower back of the wearer when the garment is being worn;

e) where in said cushion member includes a lower portion, an upper portion, and a pair of intermediate portions connecting said lower portion and said upper portion, each of said pair of intermediate portions extending along a respective one of said side edges of said back panel, said upper, lower, and intermediate portions defining a hole within said cushion member, said lower portion extending continuously between said intermediate portions, whereby said lower portion is arranged and configured to support the lower back of the wearer when the garment is being worn and said upper portion arranged and configured to support the wearer's neck when said garment is not being worn.

9. A garment for supporting the lower back of a wearer, comprising:

a) a back panel including a cushion member and having a pair of side edges;

b) a pair of side panels each attached by an edge thereof to a respective one of said side edges, at least one of said side panels comprising a pair of subpanels, said subpanels coupled to one another so as to define a pocket and an opening therebetween, said opening being in communication with said pocket, said pocket terminating at or before said side edge of said back panel to which said at least one of said side panels is attached;

c) selectively openable closure means operable to selectively open and close said opening so that said pocket may be accessed and secured by the wearer;

d) support means attached to each of said side panels arranged and configured to suspend said garment from the wearer's shoulders; and e) wherein said cushion member is positionable with respect to the wearer such that at least a portion of said cushion member supports the lower back of the wearer when the garment is being worn.

10. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders; and d) wherein said cushion member is positionable with respect to the wearer such that at least a lower portion of said cushion member supports the lower back of the wearer when the garment is being worn, said lower portion having a thickness of from about 4 to 6.5 inches.

11. A garment for supporting the lower back of a wearer, comprising:

a) a back panel including a cushion member and having a pair of side edges;

b) a pair of side panels each attached by an edge thereof to a respective one of said side edges;

c) support means attached to each of said side panels arranged and configured to suspend said garment from the wearer's shoulders; and d) wherein said cushion member is positionable with respect to the wearer such that at least a lower portion of said cushion member supports the lower back of the wearer when the garment is being worn, said lower portion, when in a relaxed condition, being contoured to substantially fit at least the vertical curvature of the wearer's lower back.

12. A garment for supporting the lower back and neck of a wearer, comprising:

a) a back panel including a cushion member and having a pair of side edges, said cushion member including a lower portion, an upper portion, and a pair of intermediate portions, each of said pair of intermediate portions extending along a respective one of said side edges, said upper, lower, and intermediate portions defining a hole within said cushion member;

b) a pair of side panels each attached by an edge thereof to a respective one of said side edges, at least one of said side panels comprising a pair of subpanels, at least one of said subpanels comprising a cushion panel, said subpanels coupled to one another so as to define a pocket and an opening therebetween, said opening being in communication with said pocket;

c) support means including a pair of straps attached to each of said side panels and arranged and configured to suspend said garment from the wearer's shoulders;

d) coupling means for selectively connecting said pair of side panels;

e) wherein said lower portion is arranged and configured to support the lower back of the wearer when the garment is being worn, and wherein each of said upper portion and said intermediate portions are arranged and configured to support the wearer's neck when the garment is not being worn; and f) wherein said lower portion is thicker than said upper portion and said intermediate portions.

13. The garment of claim 12 wherein the diameter of said lower portion is greater than the respective diameters of said upper portion and said intermediate portions.

14. The garment of claim 12 further including selectively openable closure means operable to close said opening.

15. The garment of claim 12 wherein said support means further includes adjustment means for adjusting the lengths of said straps.

16. The garment of claim 12 further including an auxiliary pocket mounted on one of said side panels.

17. A garment for supporting the lower back of a wearer, comprising:

a) a back panel including a cushion member and having a pair of side edges, said cushion member including a lower portion, an upper portion, and a portion of reduced thickness defined between said upper and lower portions, said portion of reduced thickness having a thickness less than a thickness of said upper portion and less than a thickness of said lower portion;

b) a pair of side panels each attached by an edge thereof to a respective one of said side edges;

c) support means attached to each of said side panels arranged and configured to suspend said garment from the wearer's shoulders; and d) wherein said cushion member is positionable with respect to the wearer such that at least said lower portion of said cushion member supports the lower back of the wearer when the garment is being worn.

18. The garment of claim 17 wherein said cushion member further includes at least one intermediate portion connecting said upper and lower portions and disposed adjacent said portion of reduced thickness.

19. A garment for supporting the lower back of a wearer, comprising:

a) a back panel including a cushion member and having a pair of side edges;

b) a pair of side panels each attached by an edge thereof to a respective one of said side edges, at least one of said side panels comprising first and second subpanels, said subpanels coupled to one another so as to define a pocket and an opening therebetween, said opening being in communication with said pocket;

c) at least said first subpanel including an outer panel and an interior panel coupled to one another so as to define a compartment therebetween, said interior panel facing said second subpanel and defining said pocket therebetween;

d) a cushion panel disposed in said compartment between said outer and interior panels and separated from said pocket by said interior panel;

e) support means attached to each of said side panels arranged and configured to suspend said garment from the wearer's shoulders; and f) wherein said cushion member is positionable with respect to the wearer such that at least a portion of said cushion member supports the lower back of the wearer when the garment is being worn.

20. The garment of claim 19 wherein said second subpanel includes an outer panel and an interior panel defining a second compartment therebetween, said interior panel of said second subpanel facing said interior panel of said first subpanel and defining said pocket therebetween, a second cushion panel being disposed in said second compartment and separated from said pocket by said interior panel of said second subpanel.

21. A garment for supporting the lower back and neck of a wearer, comprising:

a) a back panel including a cushion member and having a pair of side edges, said cushion member including a lower portion and an upper portion;

b) a pair of side panels each attached by an edge thereof to a respective one of said side edges, at least one of said side panels comprising a pair of subpanels, said subpanels coupled to one another so as to define a pocket and an opening therebetween, said opening being in communication with said pocket;

c) at least said first subpanel including an outer panel and an interior panel coupled to one another so as to define a compartment therebetween, said interior panel facing said second subpanel and defining said pocket therebetween;

d) a cushion panel disposed in said compartment between said outer and interior panels and separated from said pocket by said interior panel;

e) support means attached to each of said side panels arranged and configured to suspend said garment from the wearer's shoulders; and f) wherein said lower portion is arranged and configured to support the lower back of the wearer when the garment is being worn, and wherein said upper portion is arranged and configured to support the wearer's neck when the garment is not being worn.

22. The garment of claim 21 further including selectively openable closure means operable to selectively open and close said opening so that said pocket may be accessed and secured by the wearer.

23. The garment of claim 21 wherein said support means includes a pair of straps and adjustment means for adjusting the lengths of said straps.

24. The garment of claim 21 further including coupling means for selectively connecting said pair of side panels.

25. The garment of claim 21 further including an auxiliary pocket mounted on one of said side panels.

26. The garment of claim 21 wherein said second subpanel includes an outer panel and an interior panel defining a second compartment therebetween, said interior panel of said second subpanel facing said interior panel of said first subpanel and defining said pocket therebetween, a second cushion panel being disposed in said second compartment and separated from said pocket by said interior panel of said second subpanel.

* * * * *